US005192511A

United States Patent [19]

Roach

[11] Patent Number: 5,192,511

[45] Date of Patent: Mar. 9, 1993

[54] PIPETTE TIP AND PISTON

[75] Inventor: William J. Roach, Auburn, Calif.

[73] Assignee: Tri-Continent Scientific, Inc., Grass Valley, Calif.

[21] Appl. No.: 708,909

[22] Filed: May 31, 1991

[51] Int. Cl.[5] ..... B01L 3/02

[52] U.S. Cl. ..... 422/100; 422/103; 73/864.01; 73/864.11; 73/864.13; 73/864.14; 73/864.16

[58] Field of Search ..... 422/99, 100, 103; 73/864.01, 864.11, 864.13, 864.14, 864.16

[56] References Cited

U.S. PATENT DOCUMENTS

| | | | |
|---|---|---|---|
| 3,786,683 | 1/1974 | Berman et al. | 73/425.4 P |
| 4,023,716 | 5/1977 | Shapiro | 222/309 |
| 4,072,330 | 2/1978 | Brysch | 285/239 |
| 4,084,730 | 4/1978 | Franke et al. | 222/309 |
| 4,187,724 | 2/1980 | Citrin | 73/425.4 P |
| 4,362,063 | 12/1982 | Marteau d'Autry | 73/864.1 |
| 4,362,064 | 12/1982 | Marteau d'Autry | 73/864.13 |
| 4,418,580 | 12/1983 | Satchell et al. | 73/864.13 |
| 4,442,722 | 4/1984 | Meyer | 73/864.18 |
| 4,474,071 | 10/1984 | Marteau d'Autry | 73/864.13 |
| 4,501,163 | 2/1985 | MacDermott et al. | 73/864.13 |
| 4,616,514 | 10/1986 | Magnussen et al. | 73/864.14 |
| 4,672,857 | 6/1987 | MacDermott | 73/864.18 |
| 4,707,337 | 11/1987 | Jeffs et al. | 422/100 |
| 4,748,859 | 6/1988 | Magnussen et al. | 73/864.01 |
| 4,863,695 | 9/1989 | Fullemann | 422/100 |
| 4,961,350 | 10/1990 | Tennstedt | 73/864.01 |

*Primary Examiner*—James C. Housel
*Assistant Examiner*—Maureen M. Wallenhorst
*Attorney, Agent, or Firm*—John P. O'Banion

[57] ABSTRACT

A positive displacement pipette tip in which a one-piece piston having a tapered end slides within a capillary tube having a matching taper. The capillary tube includes a collar with a snap ring for attachment to the body of a pipette. The piston includes a two-prong fork-like coupling for attachment to the plunger of the pipette. Attachment of the pipette tip can be made without physical handling, and ejection is achieved by an over extension of the pipette plunger. The pipette tip has a precision outlet orifice for drawing and dispensing liquid, and is suitable for DNA research such as that involving polymerized chain reactions.

13 Claims, 3 Drawing Sheets

PIPETTE TIP AND PISTON

BACKGROUND OF THE INVENTION

1. Field of the Invention

This invention pertains generally to pipettes, and more specifically to a replaceable tip and piston assembly with unique means of attachment to the pipette.

2. Description of the Background Art

In the area of clinical and analytical chemistry research, pipettes are used for handling precise quantities of liquid. This is important in the area of deoxyribonucleic acid (DNA) research generally, and particularly that pertaining to polymerized chain reactions (PCR) which requires handling separate samples involving picograms of DNA. In order to avoid samples being tainted, instead of individual pipettes being used, disposable pipette tips have been developed which, when used with programmable pipettes, are capable of handling minute quantities of liquid. These pipette tips often include pistons which reduce the per unit volume of liquid that can be drawn into the pipette tip, and permit extraction of liquid with extreme precision. The manner of attachment of the piston to the pipette is important for maintaining repeatability in measurements, and facilitating easy attachment and removal of the pipette tip.

In order to meet the need of precise liquid handling, various pipettes and pipette tips have been developed. For example, U.S. Pat. No. 4,442,722 issued to Meyer on Apr. 17, 1984, discloses a dual stroke air displacement pipette, attached to which is a removable pipette tip. U.S. Pat. No. 3,786,683 issued to Berman et al. on Jan. 22, 1974, discloses a pistol grip style air displacement pipette having replaceable pipette tips. U.S. Pat. No. 4,616,514 issued to Magnussen, Jr. et al. on Oct. 14, 1986, discloses an air displacement pipette having resilient clips on the outside of the pipette body to retain a removable pipette tip, the clips being expandable with an overextension of the plunger to release the pipette tip. U.S. Pat. No. 4,707,337 issued to Jeffs et al. on Nov. 17, 1987, discloses an air displacement pipette having recessed and extruded rings which mate for attaching and sealing a removable pipette tip. U.S. Pat. No. 4,748,859 issued to Magnussen, Jr. et al. on Jun. 7, 1988, discloses an air displacement pipette which uses recessed and extruded rings to attach and seal a removable pipette tip. U.S. Pat. No. 4,187,724 issued to Citrin on Feb. 12, 1980, discloses an air displacement pipette using recessed and extruded rings to attach a removable pipette tip. U.S. Pat. No. 4,072,330 issued to Brysch on Feb. 7, 1978, discloses an air displacement pipette having a slip-on pipette tip which uses a flexible adaptor cone for frictional engagement. U.S. No. Pat. No. 4,863,695 issued to Fullemann on Sep. 5, 1989, discloses an air displacement pipette using sealing ribs to attach and seal a pipette tip. U.S. Pat. No. 4,961,350 issued to Tennstedt on Oct. 9, 1990, discloses an air displacement pipette which uses generic tapered surfaces for mating and sealing with a pipette tip. U.S. Pat. No. 4,023,716 issued to Shapiro on May 17, 1977, discloses a positive displacement pipette having a plunger which extends into a snap-on pipette tip which can be ejected by an overextension of the plunger. Most of these patents disclose variations of pipettes and pipette tips which have locking tapers or rings, and which are generally air displacement pipettes having air seals which are difficult to maintain. Others are higher precision positive displacement pipettes using a piston which is part of the pipette itself, and which can become contaminated from sample to sample.

In order to overcome the problems with maintaining air tight seals and to prevent against cross-contamination of samples, several positive displacement pipettes using replaceable pistons have been developed. For example, U.S. Pat. No. 4,084,730 issued to Franke et al. on Apr. 18, 1978, discloses attaching a removable pipette piston to a conical-shaped clamping ring, the clamping ring being made of a resilient material which is squeezed to clamp a piston which is inserted through the center of the clamping ring. U.S. Pat. No. 4,501,163 issued to MacDermott et al. on Feb. 26, 1985, discloses a pipette with a removable piston, the piston being attached to a plunger in the pipette body, and a snap-on tip. U.S. Pat. No. 4,362,063 issued to Marteau d'Autry on Dec. 7, 1982, discloses a piston attached to a plunger in a pipette which can be extended through a capillary tube. U.S. Pat. No. 4,362,064 issued to Marteau d'Autry on Dec. 7, 1982, discloses a pipette piston which moves through a pipette tip and which is attached to the pipette with a resilient gripping ring attached to a plunger in the pipette. The pipette tips disclosed in these patents, however, do not have integral pistons which can be automatically installed and ejected along with the pipette tip. Therefore, they are difficult to install and remove, and do not guard against contamination which can result from physical handling of the pipette tip and piston during installation and removal.

An example of a pipette tip with an integral piston, and which can be installed and removed automatically without physical handling, can be found in U.S. Pat. No. 4,474,071 issued to Marteau d'Autry on Oct. 2, 1984. That patent discloses a pipette tip with an integral piston for use with a pipette having a plunger with a collet or female receptacle to engage the end of the piston.

The foregoing patents reflect the state of the art of which the applicant is aware and are tendered with the view toward discharging applicant's acknowledged duty of candor in disclosing information which may be pertinent in the examination of this application. It is respectfully stipulated, however, that none of these patents teach or render obvious, singly or when considered in combination, applicant's claimed invention.

SUMMARY OF THE INVENTION

In general terms, the present invention is a pipette tip comprising a capillary tube through which an integral piston travels. One end of the capillary tube is tapered and contains a precision outlet orifice for drawing liquid, while the other end has an extruded ring which snaps into and mates with a groove on the pipette body. The piston itself has a tapered end matching the taper of the capillary tube and an engagement end which attaches to the plunger in the pipette body. The engagement end of the piston is unique in its design and structure, and includes fork-like projections which are adapted to grip one end of the plunger in the pipette body. When the plunger is withdrawn into the barrel of the pipette body, these fork-like projections are compressed and maintain a constant gripping force on the plunger.

High accuracy and repeatability of measurement is achieved by using the configuration of the present invention. The extruded ring on the capillary tube which mates with the groove on the pipette body assures that the pipette tip is always positioned to maintain the same distance from the liquid receiving end to the pipette body. The fork-like projections at one end of the piston are sized so that the plunger extends into and bottoms out against the piston when the pipette tip is installed. This assures that the tapered end of the piston will always be positioned to maintain the same distance from the pipette body to the liquid receiving end of the capillary tube. Calibration can then be maintained from sample to sample as the pipette tips are replaced, because the pipette tip is automatically zeroed when inserted.

The present invention also uses a short stroke piston. This feature permits a wider range of liquid volumes per pipette tip. For example, for a liquid handling range of 0.1 to 250 microliters, only two different sizes of pipette tips are required, as opposed to three or more sizes being required for other devices such as that disclosed in U.S. Pat. No. 4,474,071. Furthermore, unlike the piston of U.S. Pat. No. 4,474,071 which must be fabricated from a wire, flange, and piston tip member, the piston of the present invention can be injection molded as a single piece from material such as polyethylene. This feature significantly reduces manufacturing cost and, in addition, consistency in fabrication can be more easily maintained.

Additionally, to prevent contamination of samples which would otherwise result from the user physically handing the capillary tube or piston, the pipette tip can be installed by simply snapping the pipette body into a pipette tip resting in a pipette rack. Ejection of the pipette tip is automatic when the plunger is overextended. As such, the user will never touch the capillary tube or piston.

By including an interior taper in the capillary tube at one end, a tapered piston can be used. This feature, in conjunction with a precision outlet orifice, permits a shorter stroke and larger bore to be used, while still maintaining good dispensing characteristics, thereby overcoming the deficiencies of other devices which usually have straight bores and cannot be used for dispensing liquids over a wide range without changing pipette tip sizes.

An object of the invention is to provide a pipette tip which will be perfectly calibrated when installed on a pipette.

Another object of the invention is to provide a pipette tip which can be installed and ejected automatically by depressing and releasing the pipette plunger.

Another object of the invention is to provide a pipette tip which can be installed and ejected without physical handling.

Another object of the invention is to provide a piston which has gripping fingers for engaging the plunger in a pipette.

Another object of the invention is to provide a piston which is automatically and positively gripped by the pipette body when installed.

Another object of the invention is to provide a piston which attaches to the pipette plunger in a constant position.

Another object of the invention is to provide a positive displacement pipette tip of high accuracy and repeatability of measurement.

Another object of the invention is to reduce the stroke required for handling a given volume of liquid.

Another object of the invention is to provide for handling small quantities of liquid.

Another object of the invention is to provide for one-piece piston design to reduce fabrication costs.

Another object of the invention is to eliminate the need for zeroing prior to handling a liquid sample.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Referring more specifically to the drawings, for illustrative purposes the present invention is embodied in the apparatus generally shown in FIG. 1 through FIG. 4. It will be appreciated that the apparatus may vary as to configuration and as to details of the parts without departing from the basic concepts as disclosed herein.

Figure 1:
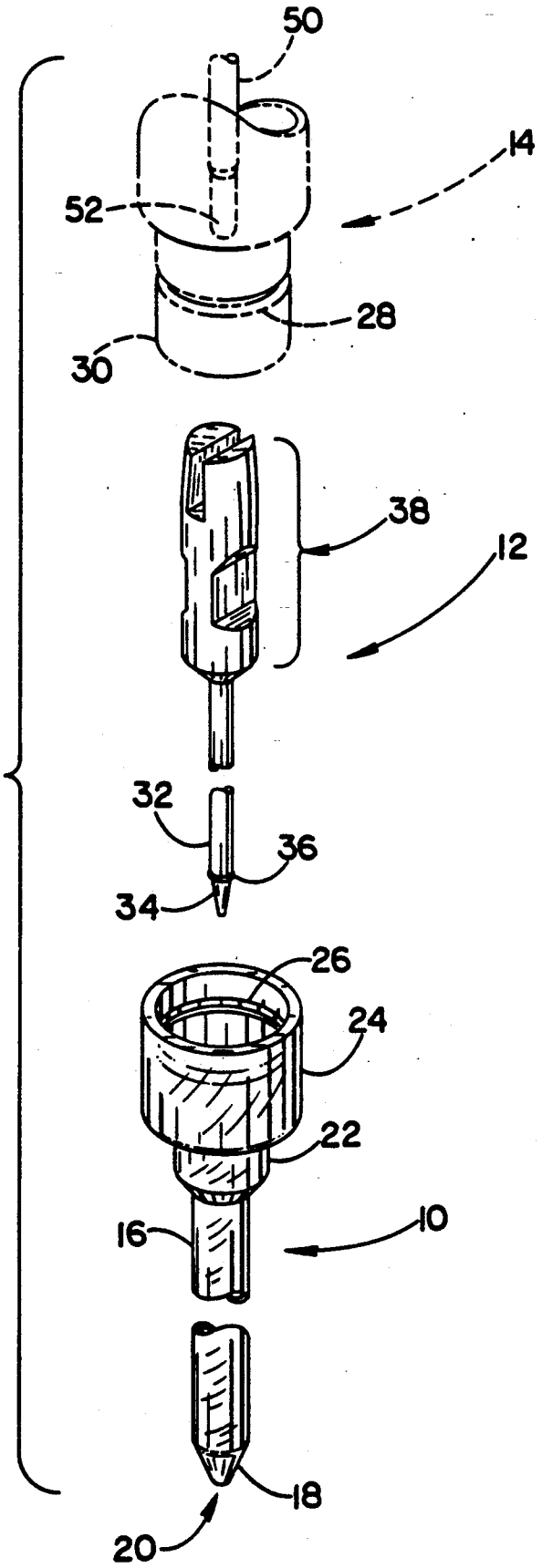
FIG. 1 is an exploded view of the apparatus with the attachment end of a pipette body shown in phantom.

Referring to FIG. 1, the apparatus generally comprises piston chamber 10 and piston 12 which, when attached to pipette body 14, comprises a complete pipette assembly for drawing and dispensing small quantities of liquid. Because of its design and configuration, the apparatus is particularly well suited for use in DNA research involving polymerized chain reactions.

Figure 2:
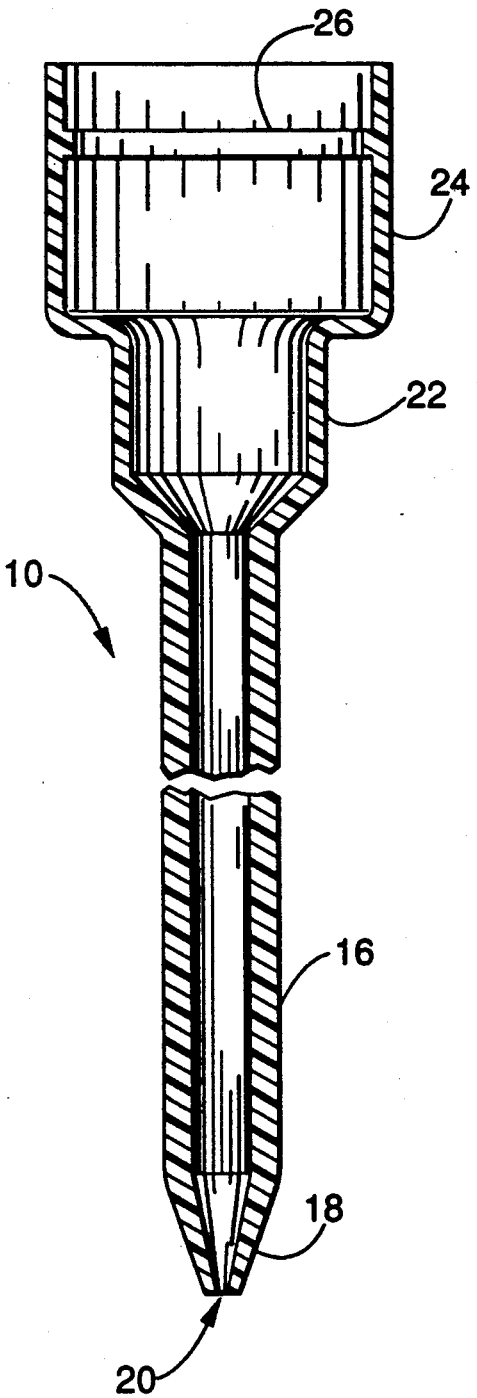
FIG. 2 is a cross-sectional view of the capillary tube portion of the apparatus shown in FIG. 1.

Referring to FIG. 1 and FIG. 2 together, piston chamber 10 includes tube 16 which is open on each end, slender, and has a very small bore; that is, tube 16 is typically capillary. Located at one end of piston tube 16 is a conical taper 18. Conical taper 18 is both an internal and external taper and terminates at outlet orifice 20. Outlet orifice 20 is an extremely small, high precision opening which is typically 0.01 to 0.015 inches in diameter. Situated at the other end of tube 16 is a radially projecting neck 22 which is tapered at one end and cylindrical at the other end. Situated at the cylindrical end of neck 22 is a radially projecting collar 24 which is cylindrically shaped at both ends. Located within the interior region of collar 24 is a thin projecting annular zone, or snap ring 26. Snap ring 26 serves as a means to couple collar 24, and therefore piston chamber 10, to pipette body 14. Pipette body 14 includes a corresponding groove 28 which mates with snap ring 26. Collar 24 slides over barrel 30 and snap ring 26 expands until its seats in groove 28. Piston chamber 10 is typically made of resilient thermoplastic material such as polyethylene, and injection molded as a single piece.

Figure 3:
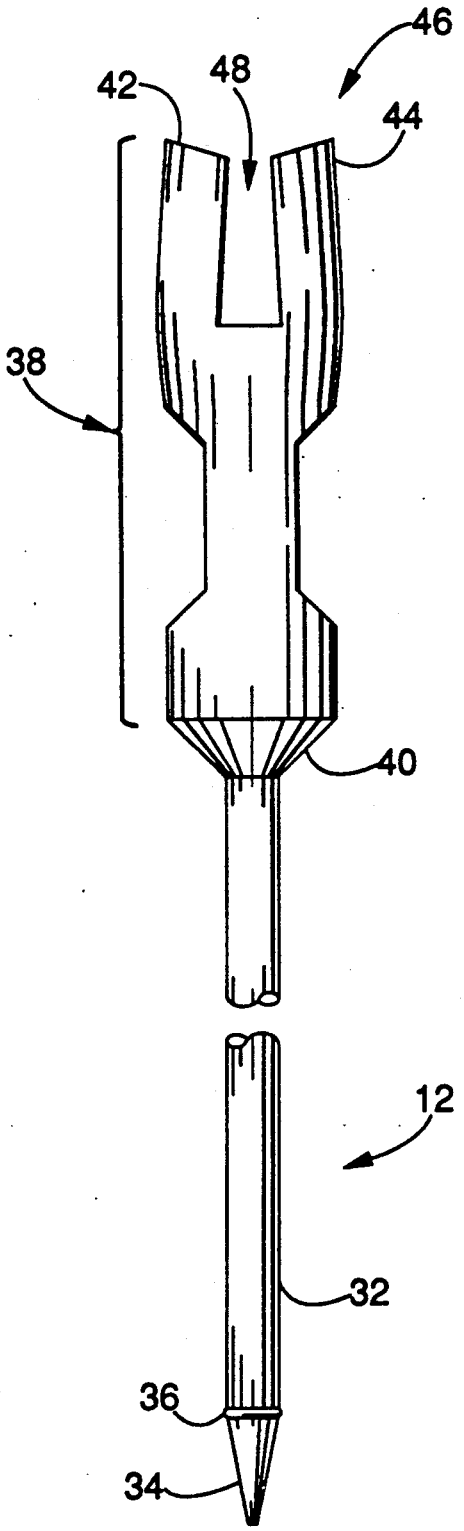
FIG. 3 is a side elevation view of the piston portion of the apparatus shown in FIG. 1.

Referring to FIG. 1 and 3 together, piston 12 includes a cylindrical shaft 32. Located at one end of shaft 32 is conical taper 34 which matches taper 18 at one end of tube 16. Located at the point of transition between shaft 32 and conical taper 34 is an annular projecting zone, or sealing ring 36. When piston 12 is inserted into piston chamber 10, sealing ring 36 forms an air tight seal between piston 12 and the inner wall of tube 16. This seal is necessary for displacement of liquid drawn into piston chamber 10.

Located at the other end of shaft 32 is attachment head 38 which includes a tapered neck 40 at one end, the taper of neck 40 matching the taper of neck 22 at one end of tube 16. Extending from the other end of attachment head 38 are spaced apart opposing prongs 42, 44 which form a fork-like receptacle 46. Prongs 42, 44 have arcuate inner and outer walls to form smooth, rounded surfaces. The ends of prongs 42, 44 are beveled and converge to form entry port 48 in receptacle 46.

Piston 12 is typically made of resilient thermoplastic material such as polyethylene, and injected molded as a single piece. It is particularly important that prongs 42, 44 be made of resilient material so that they can be expanded without breakage.

Figure 4:
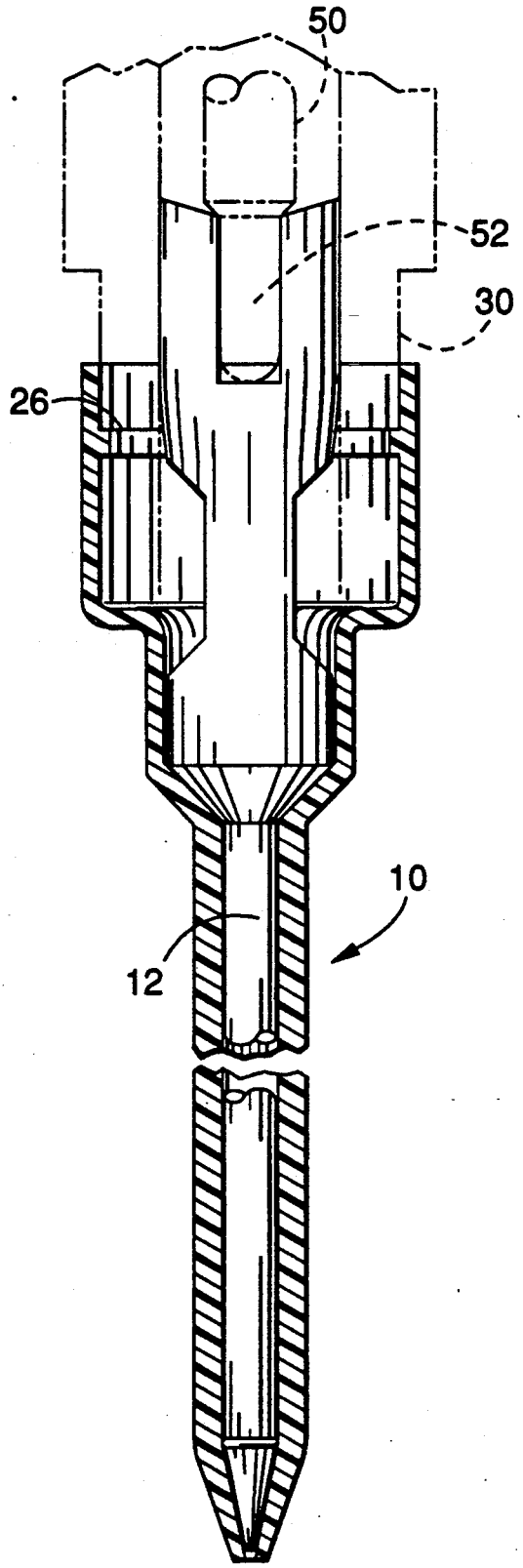
FIG. 4 is a composite of the views shown in FIG. 2 and FIG. 3, and shows the apparatus attached to a pipette body shown in phantom.

Attachment of the apparatus to a pipette body 14 can be seen from FIG. 4. Piston 12 is inserted into piston chamber 10 to form a pipette tip assembly. Snap ring 26 engages groove 28 in barrel 30 of pipette body 14 for secure attachment. Tip 52 at the end of plunger 50 is inserted into receptacle 46 of piston 12 until tip 52 bottoms out in receptacle 46. Prior to insertion of tip 52, prongs 42, 44 are inserted into barrel 30. During insertion of tip 52, the converging ends of prongs 42, 44 are expanded to widen entry port 48 and force prongs 42, 44 against the inner wall of barrel 30. Positive frictional engagement is maintained in two ways. First, the resiliency of prongs 42, 44 causes them to clamp against tip 52 when expanded. Second, barrel 30 compresses prongs 42, 44 against tip 52 since the inner diameter of barrel 30 is sized to mate with prongs 42, 44 prior to being expanded by tip 52.

Under most laboratory research conditions, it is critical that liquid handling instruments be clean and that no contamination result from either attaching or detaching a pipette tip. This need is met because installation of the apparatus to a pipette bodily can be effected without physical handling of either piston chamber 10 or piston 12. Prior to installation, the assembly of piston chamber 10 and piston 12 rest in a pipette rack. The end of barrel 30 is then vertically oriented over collar 24, downward vertical pressure is applied until prongs 42, 44 enter barrel 30, tip 52 engages receptacle 46, and snap ring 26 engages groove 28. Piston chamber 10 and piston 12 will then be looked onto pipette body 14. Removal is effected by reversing the process and overextending plunger 50. An overextension of plunger 50 will force neck 40 on piston 12 against neck 22 on piston chamber 10 and eject both piston chamber 10 and piston 12 as an assembly.

Accordingly, it will be seen that this invention provides for the handling of small quantities of liquid efficiently, accurately, and without risk of cross-contamination. Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. A fluid handling apparatus for a pipette, comprising:

(a) a tube, said tube including an open first end and an open second end, said tube including interior and exterior walls, said interior and exterior walls being conically tapered toward said first end;

(b) a radially projecting collar, said collar extending from said second end of said tube, said collar including an interior region;

(c) snap coupling means for coupling said collar to the body of a positive displacement pipette, said snap coupling means located within said interior region of said collar;

(d) a piston, said piston extending into said tube, said piston having a first end and a second end, said first end of said piston aligned with said first end of said tube, said piston being conically tapered toward said first end, said piston being slidable within said tube; and (e) a plurality of spaced apart inwardly converging resilient prongs, said prongs extending from said second end of said piston, said prongs having beveled ends, said prongs forming a receptacle for coupling to a plunger in a positive displacement pipette, whereby said prongs will expand outwardly upon insertion of a plunger in a positive displacement pipette into said receptacle thereby frictionally engaging the plunger.

2. The apparatus as recited in claim 1, wherein said tube is a capillary tube.

3. The apparatus as recited in claim 1, wherein said collar includes a receptacle for receiving the body of a positive displacement pipette.

4. The apparatus as recited in claim 1, wherein said snap coupling means comprises a thin projecting annular zone.

5. The apparatus as recited in claim 1, wherein said prongs have arcuate surfaces and beveled ends.

6. The apparatus as recited in claim 1, further comprising a sealing ring, said sealing ring positioned near said tapered end of said piston.

7. A positive displacement pipette tip, comprising:

(a) a tube, said tube including an open first end and an open second end, said tube including interior and exterior walls, said interior and exterior walls being conically tapered toward said first end to form a precision outlet orifice;

(b) a radially projecting collar, said collar extending from said second end of said tube, said collar including an interior region;

(c) a piston, said piston extending into said tube, said piston having a first end and a second end, said first end of said piston aligned with said first end of said tube, said piston being conically tapered toward said first end, said piston being slidable within said tube;

(d) a plurality of spaced apart inwardly converging resilient prongs, said prongs extending from said second end of said piston, said prongs having beveled ends, said prongs forming a receptacle for coupling to a plunger in a positive displacement pipette, whereby said prongs will expand outwardly upon insertion of a plunger in a positive displacement pipette into said receptacle thereby frictionally engaging the plunger.

(e) snap coupling means for coupling said collar to the body of a positive displacement pipette, said snap coupling means located within the interior region of said collar.

8. The apparatus as recited in claim 7, wherein said tube is a capillary tube.

9. The apparatus as recited in claim 8, wherein said collar includes a receptacle for receiving the body of a positive displacement pipette.

10. The apparatus as recited in claim 9, wherein said snap coupling means comprises a thin projecting annular zone.

11. The apparatus as recited in claim 10, wherein said prongs have arcuate surfaces and beveled ends.

12. The apparatus as recited in claim 11, further comprising a sealing ring, said sealing ring positioned near said tapered end of said piston.

13. A fluid handling tip for a positive displacement pipette, comprising:

(a) a capillary tube, said capillary tube having an open first end and an open second end, said capillary tube including interior and exterior walls, said interior and exterior walls being conically tapered toward said first end to form a precision outlet orifice;

(b) a radially projecting collar, said collar extending from said second end of said tube, said collar including a receptacle, said receptacle including a thin projecting annular zone for coupling to the body of a pipette;

(c) a piston, said piston extending into said tube, said piston having a first end and a second end, said piston being conically tapered toward said first end, said piston being slidable within said tube, said piston including a sealing ring located near said first end, said first end of said piston aligned with said first end of said tube; and (d) a plurality of spaced apart inwardly converging resilient opposing prongs, said prongs extending from said second end of said piston, said prongs forming a receptacle for coupling to a plunger in a pipette, said prongs having arcuate outer surfaces and a beveled end, whereby said prongs will expand outwardly upon insertion of a plunger in a positive displacement pipette into said receptacle thereby frictionally engaging the plunger.

* * * * *